US005801128A

United States Patent [19]

Overstreet et al.

[11] Patent Number: 5,801,128

[45] Date of Patent: Sep. 1, 1998

[54] HOT MELT LUBRICANT AND METHOD OF APPLICATION

[75] Inventors: Thomas S. Overstreet, Highland Park; Arthur E. Dampts, Wilmette, both of Ill.

[73] Assignee: International Refining and Manufacturing Company, Evanston, Ill.

[21] Appl. No.: 553,794

[22] Filed: Oct. 23, 1995

[51] Int. Cl.[6] ..... C10M 111/04; C10M 169/04; C10M 173/02

[52] U.S. Cl. ..... 508/159; 508/160; 72/42

[58] Field of Search ..... 252/49.3, 25, 52 A, 252/49.8, 51.5 R; 72/42; 508/562, 159, 160

[56] References Cited

U.S. PATENT DOCUMENTS

| | | | |
|---|---|---|---|
| 3,265,620 | 8/1966 | Heiman | 252/33.6 |
| 3,657,123 | 4/1972 | Stram | 252/34.7 |
| 4,113,635 | 9/1978 | Sakurai et al. | 252/49.6 |
| 4,116,872 | 9/1978 | Jahnke | 252/32.5 |
| 4,191,801 | 3/1980 | Jahnke | 428/467 |
| 4,250,046 | 2/1981 | Przybylinski | 252/49.3 |
| 4,256,594 | 3/1981 | Rysek | 252/49.9 |
| 4,321,308 | 3/1982 | Jahnke | 428/469 |
| 4,378,998 | 4/1983 | Korbanka et al. | 106/270 |
| 4,454,050 | 6/1984 | Bertell | 252/42 |
| 4,753,743 | 6/1988 | Sech | 252/33.4 |
| 4,800,033 | 1/1989 | Stetter | 252/55 |
| 4,839,067 | 6/1989 | Jansen | 252/49.3 |
| 4,846,986 | 7/1989 | Trivett | 252/49 |
| 4,927,550 | 5/1990 | Cutcher et al. | 252/32.5 |
| 4,999,241 | 3/1991 | Coduti et al. | 428/430 |
| 5,069,806 | 12/1991 | Trivett | 252/52 A |

*Primary Examiner*—Margaret Medley
*Attorney, Agent, or Firm*—Palmatier, Sjoquist, Helget & Voigt, P.A.

[57] ABSTRACT

A dry Non-Oil metalworking lubricant that can be applied by a hot melt application. This dry lubricant is completely water soluble, provides rust protection, cleans from surfaces with plain room temperature water, and is more environmentally safe than other lubricants. A polyethylene glycol of sufficiently high molecular weight to be solid at room temperature is combined with amines, rust inhibitors, and metalworking additives to produce a thin film that provides protection for the part and the tooling in a metalworking operation. This lubricant provides further benefits to the overall process such as; easy to clean, weld through capability, excellent paint system compatibility, and environmentally superior to other lubricants.

11 Claims, 1 Drawing Sheet

HOT MELT LUBRICANT AND METHOD OF APPLICATION

BACKGROUND OF THE INVENTION

The present invention allows metalstampers the flexibility of using a hot melt lubricant for coating coils of strip steel or coating blanks that are then worked at the press. Metalstampers perform operations such as; stamping, drawing, bending, forming, blanking, punching, cutting, rolling, forging, and other types of metalworking.

Lubricants are designed to reduce friction between the metal being worked and the tooling. This reduces the amount of energy necessary to make the part. It reduces damage to the part and the tooling during the metalworking operation. The lubricant should also provide protection from staining and corrosion of the part and the tooling. The lubricant should prevent sticking of the part and the tool and also prevent sticking of one part to another.

In general there are two types of compositions which are used to effect a temporary rust-prevention and/or forming lubrication of steel plates, one of which is the liquid film type, contains components capable of improving the rust-proof and lubrication added into a base oil, for example, mineral oil, animal oil, or vegetable oil, such as, metal working oil, and anti-rusting oil, etc., and the other of which is of the solid film type and contains a fatty acid, or fatty acid soap as the main constituent.

In comparing both types, the liquid coating type has the disadvantage that when the steel plates are fabricated by press forming some of the coating drops onto the floor and a dangerous slipping hazard exists. Moreover, the environment is polluted by the bad odor and scattering of the liquid which soils the clothes of the operators. Also, formability can not be kept constant because the coating can not be held for long periods in the quality or quantity necessary for forming.

On the other hand, the solid coating does not present such problems. But known solid coating compositions must be dissolved in hot water, or an organic solvent before use, and the steel plates coated with the solution must be heated to dryness to remove the water or the solvent.

On the one hand, the solid coating type has a better effect on stamping than the liquid coating type as mentioned above. On the other hand, the coating process prior to forming is more complicated, and requires facilities for coating and for drying by heating. Further, heating lowers the quality of the steel sheet itself due to the strain aging effect, so that it is not common to apply the solid coating type in place of the liquid coating type.

However, when steel plate makers manufacture steel plates coated with rust-proof lubricant compositions of the solid film-type, users can directly place the coated steel plate into the forming operation without encountering the above-mentioned problems so that improvements in the operating conditions and productivity to counterbalance the additional costs will be easily achieved.

Rust-proof lubricants of the solid film-type are classified as of the solvent-type, aqueous solution-type, and reaction type.

The principal constituents of the solvent-type, such as, fatty acid, extreme pressure additives, rust-preventives, etc., must be dissolved in an organic solvent before applying it on steel plates. In the case of the aqueous solution type, the principal constituents which are metal soaps of fatty acid and certain water-soluble organic compounds and inorganic compounds must be dissolved in hot water, and the coating applied on metal plates is dried by heating to form a solid film. In the reaction type, there is a lubricant comprising a phosphate-fatty acid soap. However, these conventional rust-proof lubricant compositions of the solid film type have many disadvantages, e.g.:

(1) The solvent-type uses an organic solvent so that when a large amount of the composition is used, for example, in the process for coating coils of steel sheets continuously, there arise the dangers from fire and explosion, sanitary problems, and special facilities are thus made necessary. Even if a highly noncombustible solvent is used, operators will not be free from the sanitary problems, such as bad odor, poisoning by solvent, etc., and special facilities are thus made necessary. Further, the waste gases produced when drying present pollution problems. Additional problems include difficulty in degreasing in a short period of time in the surface-treating step after the forming operation.

(2) The aqueous solution type does not have the above-mentioned danger from fire, or poisoning by solvent, because of the use of water, but high temperatures and long periods of time are necessary for drying, so that it is not only difficult to apply at a high speed on coils of steel plates, but also it is unsuitable to use for aging steel plates of which the mechanical properties are lowered by heating. Furthermore, since there is a close relationship between the melting point of compositions of the solid film-type and pressing formability, the conventional water-soluble coatings are, in most cases, composed of compounds having high melting points, such as fatty acid soaps and do not melt at the time of stamping. In the drawing process, coating film is rubbed off by the die surface and especially by the die throat, and then fragments of the coating film pile on the die surface which hinders the steel plates from sliding into the dies. Further, the film does not have enough fluidity to cover again the naked surface rubbed off by drawing in larger sizes, therefore, causing pressing damages or reducing the pressing formability.

(3) The reaction-type complicates both the coating treatment and the subsequent removal treatment.

As has been mentioned above, while the conventional rust-proof lubricants have many defects, the present invention overcomes all of these defects and provides compositions having very important properties.

It has also been taught that there can be problems associated with the wet application of a dry film. Drying equipment can be costly and significantly slow down the coating process. Equipment used in such an operation can also require a large amount of floor space which is also an added cost.

Air quality in metalstamping plants is always a concern. Very few operations continue to use volatile organic solvents in their operation due to the potential health and flammability hazard associated with them. Most typical lubricants are low volatility liquids that minimize the possibility of air contamination.

Some dry films add to air quality problems. Odors or dust from some dry films are undesirable to press operators. Dust from stearate soap type dry films has been known to cause respiratory problems for workers. Increased precautions are required for workers such as dust masks. Plant operation costs increase because of the need for ventilating and filtering equipment necessary to improve the air quality.

Many parts are welded to one another in the metalstamping industry. Fabricators are trying to make their process more efficient by reducing steps. One way to save time and energy costs is to eliminate washing of parts before welding. Any lubricant that is burned should not pose a toxicity hazard. Lubricants that burn cleanly without large volumes of smoke and odor are preferred. The lubricant must leave no residue to ensure the integrity of the weld.

Lubricants that were able to make the most difficult parts were usually the hardest to clean. Chlorinated paraffins and pigmented pastes are good examples of materials that are hard to clean. Some newer materials, although easier to clean, still rely on alkaline cleaners for removal from metal surfaces. Some products even claim high temperatures are not necessary to remove their product but they still require elevated temperatures (120F.–140F.) to remove the lubricant. These products are generally formulated with surfactants to help improve their cleanability. Waste streams that contains such compounds are typically more toxic to aquatic life.

Chemical compatibility of the lubricant with the process after the part is formed is an important consideration. Parts are often cleaned and painted. E-coat systems are very sensitive to chemical contamination, which can cause paint defects. The further along the process a defect occurs, the more costly it is to the process. Stopping paint defects becomes as important as forming the part. Lubricants that do not clean easily or that become trapped in areas of severe bending, can cause problems in a paint system. Weeping of a lubricant from a trapped area can occur after the washing of the part, providing an area that may be more difficult to paint and therefore cause a defect. Therefore compatibility with cleaning and paint systems is a must.

SUMMARY OF THE INVENTION

A dry non-oil metalworking lubricant that can be applied by a hot melt application. This dry lubricant is completely water soluble, provides rust protection, cleans from surfaces with plain room temperature water, and is more environmentally safe than other lubricants. A polyethylene glycol of sufficiently high molecular weight to be solid at room temperature is combined with amines, rust inhibitors, and metalworking additives to produce a thin film that provides protection for the part and the tooling in a metalworking operation. This lubricant provides further benefits to the overall process such as: easy to clean, weld through capability, excellent paint system compatibility, and environmentally superior to other lubricants.

A principal object of this invention is to provide improved metal working lubricant compositions, a method for application of the lubricant, provide easy to remove lubricants, and to provide an environmentally safe material in all cases.

Another object and advantage of this invention is that the hot melt lubricant is solid at room temperature and therefore does not drip onto the floor like liquid coating lubricants.

Another object and advantage of this invention is that it can be dissolved in room temperature water and does not require hot water or organic solvents like solid film type lubricants comprised of fatty acids or fatty acid soaps.

Another object and advantage of this invention is that it does not require heating in order to dry the metal substrate to remove water or solvent.

Still another object and advantage of this invention is that is non-toxic and non-combustible and does not present pollution problems such as is the case with solvent-type solid film lubricants of the prior art.

Another object and advantage of this invention is that the lubricant can be welded through without leaving a residue to interfere with the integrity of the weld and without producing toxic smoke.

Still another object and advantage of this invention is that it can be cleaned from the metal substrate with room temperature water.

Another object and advantage of this invention is that it is compatible with paint systems so that the paint system will not be impaired by chemical contamination.

DETAILED DESCRIPTION OF THE PREFERRED EMBODIMENTS

Figure 1:
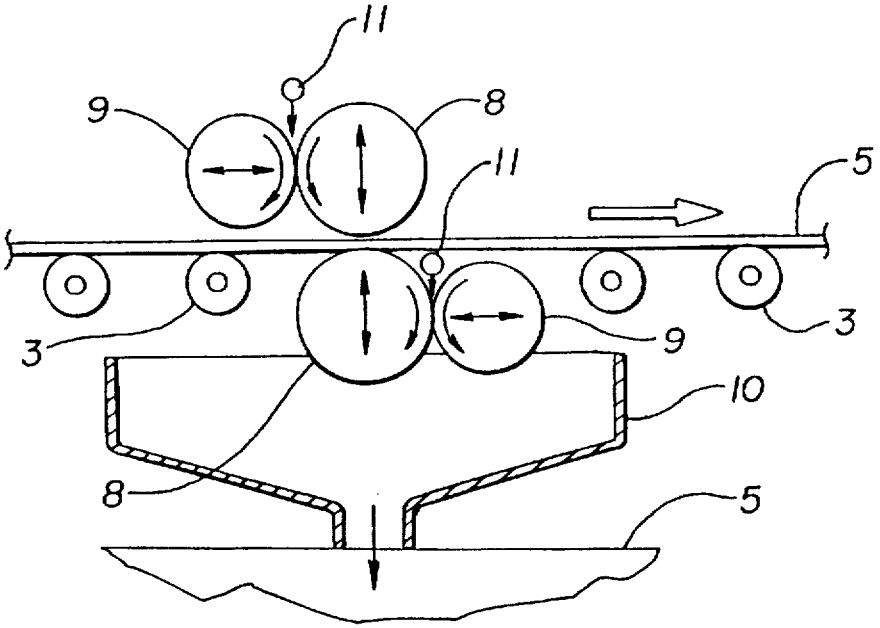
FIG. 1 is a cross-section of roller coating machinery used to apply the lubricant to metal substrates.

The dry, non-oil, water-soluble metalworking lubricant of the present invention comprises a mixture of polyethylene glycol and an amine.

Preferably, the polyethylene glycol is of sufficient molecular weight to be solid at room temperature.

The polyethylene glycol preferably is of low enough molecular weight that it is soluble in water at room temperature.

It has been found that a molecular weight in the range of 8,000 to 20,000 is preferable, although this range should not be taken as limiting. Typical commercial products which may be used as the polyethylene glycol component include polyethylene glycol compound 20M and Carbowax polyethylene glycol 8000 from Union Carbide Chemicals and Plastics Company, Inc., Danbury, Conn.

The amine component is preferably an aliphatic amine. Preferably, the aliphatic amine is selected from the group consisting of triethanolamine, diethanolamine, monoethanolamine, triisopropanolamine, diisopropanolamine, and monoisopropanolamine. Commercial products which are usable as the amine component include AMP-95 (2-amino-2-methyl-1-propanol) from ANGUS Chemical Company; isopropanolamine mixture product code 42150 from Dow Chemical Company; and triethanolamine, 99% low freezing grade (PM-4024) from Union Carbide Chemicals and Plastics Company, Inc.

The dry, non-oil, water-soluble metalworking lubricant of the present invention may also include water. Water helps to reduce the viscosity of the material being mixed and reduces the amount of heat required to get all the components into solution. The addition of water during the coating process can reduce the viscosity of the melt and allow for lower coating weights of the dry film than could be achieved without it. This is possible due to the complete water solubility of all the components in the formula.

Preferably, the dry, non-oil, water-soluble metalworking lubricant of the present invention comprises a mixture of polyethylene glycol, amine, and water in the proportions of 35% to 75%, 1% to 25%, and 0% to 30%, by weight, respectively.

The dry, non-oil, water-soluble metalworking lubricant of the present invention may also include a rust inhibitor. Rust inhibitors can be varied to provide as little or as much rust protection as necessary. The rust inhibitor must be water soluble and compatible with polyethylene glycol. A commercial product that may be used is Idasol D-845 amine complex from Ideas, Inc.

The dry, non-oil, water-soluble metalworking lubricant of the present invention may also include polyalkylene glycol as a metalworking lubricant. Typical commercial products that may be used are UCON Metalworking Lubricant EPML-483 and UCON Metalworking Lubricant ML-566, both from Union Carbide Chemicals and Plastics Company, Inc.

The dry, non-oil, water-soluble metalworking lubricant of the present invention may also include a phosphate ester extreme-pressure additive and lubricant. A typical commercial product is Chemax P-Phos-7 organic phosphate ester from Chemax, Inc.

The dry, non-oil, water-soluble metalworking lubricant of the present invention may also include a surfactant. Typical commercial products include IGEPAL CO-630 from Rhone-Poulenc, Cranbury, N.J.; and ANTAROX BL-225, also from Rhone-Poulenc.

Another component of the dry, non-oil, water-soluble metalworking lubricant of the present invention may be borax (sodium tetraborate decahydrate), commercially available from U.S. Borax.

A biocide material may also be included in The dry, non-oil, water-soluble metalworking lubricant of the present invention to keep microbes and molds from affecting the product. Typical commercial products are BUSAN 1060 from Buckman Laboratories, Lake Placid, N.Y.; and BIOBAN P-1487 from Angus Chemical Company, Buffalo Grove, Ill.

Without being limiting, a preferred formula for The dry, non-oil, water-soluble metalworking lubricant of the present invention is:

| Component | Preferred % | Range % |
|---|---|---|
| Water | 20.0 | 0–30 |
| Amine | 16.0 | 0–25 |
| Polyethylene glycol | 47.9 | 35–75 |
| Rust Inhibitor | 6.4 | 0–15 |
| Polyalkylene glycol | 3.2 | 0–15 |
| Phosphate ester | 6.4 | 0–15 |
| Surfactant | 0.1 | 0–5 |
| Borax | | 0–5 |
| Biocide | | 0–5 |

EXAMPLES

A. CLEANING TESTS (wt. in grams)

| Sample | A | B | C | D | E |
|---|---|---|---|---|---|
| Water | 20.0 | 20.0 | 0.0 | 20.0 | 20.0 |
| Amine | 16.0 | 16.0 | 16.0 | 16.0 | 16.0 |
| PEG 20M | 47.9 | 0.0 | 0.0 | 0.0 | 0.0 |
| Carbowax | 0.0 | 47.9 | 47.9 | 47.9 | 47.9 |
| Rust Inhibitor | 6.6 | 6.4 | 6.4 | 6.4 | 0.0 |
| Polyalkylene glycol | 3.2 | 3.2 | 3.2 | 3.2 | 3.2 |
| Phosphate ester | 6.4 | 6.4 | 6.4 | 6.4 | 6.4 |
| Surfactant | 0.1 | 0.1 | 0.1 | 0.0 | 0.1 |

These samples were compared to a competitive straight oil product and a competitive soluble oil product for the ability to be cleaned from a metal substrate at room temperature. A copper strike test was used to determine cleanability according to the following procedure:

Coat four cleaned 1"×2" cold rolled steel strips with product by dipping the test strip into the product to be tested. Stand strips upright and allow excess to run down. Put one of the strips in the oven for an hour @180° F.). Let the other air dry.

Weigh out 40 grams of a 4% solution of copper sulfate into a 50 ml beaker. To make up the solution for one sample:

| | |
|---|---|
| copper sulfate | 1.6 grams |
| DI water | 38.4 grams |

Prepare a beaker of 150 grams of 77° F. tap water. Put the beaker on the stirrer and set at 1.5 on new magnetic stirrer. Hang one of the panels into the water for 30 seconds. Remove the test strip from the water.

Put the copper sulfate solution on the stirrer and set at 6. Hang the cleaned panel in the copper sulfate solution for 30 seconds. Remove the panel and determine the amount of copper plated to the steel. If the test strip has a uniform shiny copper color, then the panel is clean.

Repeat for the other test strip using a fresh solution of copper sulfate.

| Cleanability Data - Copper Strike Test | |
|---|---|
| Sample A | Pass |
| Sample B | Pass |
| Sample C | Pass |
| Sample D | Pass |
| Sample E | Pass |
| Str Oil | Fail |
| Sol Oil | Fail |

B. RUST INHIBITION TESTS

The above samples were tested for inhibition of rusting of cast iron. The results are as follows, as compared to a competitive straight oil product and a competitive soluble oil product.

Samples were tested for their rust inhibiting effect according to the following procedures:

Clean the cast iron plate for the rust test. ALWAYS WEAR SAFETY GLASSES WHEN POLISHING THE PLATE WITH THE DRILL. Use the brown Scotchbrite buffer to polish the plate and remove any rust or stains. For hard to remove impurities, attach the green Combi-S buffer. Afterwards, use the sanding screens to smooth out the surface.

PETROLEUM ETHER IS EXTREMELY FLAMMABLE. ONLY USE THIS MATERIAL IN A WELL-VENTILATED AREA LIKE THE HOOD.

When the surface is smooth and clean, take the plate to the hood and wipe the surface with a paper towel saturated with petroleum ether to remove any dirt and oil. Repeat once. Do not throw the paper towels into the garbage immediately. Set them in the hood to allow the Petroleum ether to evaporate from the towels.

Prepare the dilutions for the test. Generally, more concentrated dilutions are placed on the left. Also, it is rarely necessary to make 100 gram samples of each test solution. There are two ways to prepare the dilutions. The first method minimizes weighing errors and is faster than method 2. Method 2 can be done without the use of a calculator.

Method 1:

Put a clean beaker on the balance and press the zero bar. Add a small amount of the product to be tested. Higher dilutions need less sample than the lower dilutions.

Example: To make about 10 grams of a 10% dilution, use about 1 gram of product. To make about 10 grams of a 2% dilution, use about 0.2 grams.

Read the weight of the amount added and enter it into the calculator. Multiply this number by 100 and then divide that number by the desired dilution percentage. Add water to the beaker until the number on the calculator and the number displayed on the balance match.

Example: weight of sample×100/desired percentage=total weight.

0.534 grams×100/4=13.350

In this example, 0.534 grams of product were put in the beaker and then DI water was added until the balance displayed 13.350

Method 2:

An 8% dilution can be prepared by weighing 8 grams of product into a plastic beaker and then filling the beaker up with DI water for a total of 100 grams (that means 92 grams of water are being used). For convenience, dilutions may be made out of a 25 gram total. For an 8% dilution, 2 grams of product are combined with DI water for a total of 25 grams.

8 g. product divide top by 4=2 g. product=0.08 or 100 g. total divide bottom by 4 25 g. total 8% dilution For a 1% dilution:

1 g. product divide top by 4=0.25 g. product=0.01 or 100 g. total divide bottom by 4 25 g. total 1% dilution Testing prepared solutions:

Arrange the filter paper squares on the plate. Place the plate in the large Kimax beaker and replace the cover. Make sure there is water in the bottom of the large beaker. Start with the most dilute sample from each product. The samples need to be well mixed. Draw fluid into the dropper and then squeeze it out several times to ensure the solution is well mixed. Work from right to left, proceeding from the most dilute to the most concentrated. Remove as much of the previous fluid as possible from the dropper before proceeding to the next solution. Lift the lid only as far as necessary to add the fluid to the square. Add enough fluid so that the paper is saturated, but not enough so that the fluid runs into the next square (about 3–4 drops).

Make a diagram of what the samples are and their dilutions on a note card. Identify products by rows and dilutions by columns. Write down the time and the date the test was started. Tests usually run about three hours. If large amounts of rust occur early, stop the test sooner. Record the time that the test was concluded.

| Cast Iron Rust Test | |
|---|---|
| Sample A | 4% |
| Sample B | 4% |
| Sample C | 4% |
| Sample D | 4% |
| Sample E | 7% |
| Str Oil | 8% |
| Sol Oil | 6% |

Samples formulated as below were also tested for rust inhibition in long-term storage of metal substrates.

| Rust Inhibition Tests | | |
|---|---|---|
| Sample | A | B |
| Water | 20.0 | 20.0 |
| Amine | 16.0 | 16.0 |

-continued

| Rust Inhibition Tests | | |
|---|---|---|
| Sample | A | B |
| PEG 20M | 47.9 | 0.0 |
| Carbowax 8000 | 0.0 | 47.9 |
| Rust Inhibitor | 6.4 | 6.4 |
| Polyalkylene glycol | 3.2 | 3.2 |
| Phosphate ester | 6.4 | 6.4 |
| Surfactant | 0.1 | 0.1 |

The above formulas were coated onto to Q-panels for long-term storage evaluation.

| Sample | A | B |
|---|---|---|
| 3 months | stable film, no rust | stable film, no rust |
| 6 months | stable film, no rust | stable film, no rust |
| 9 months | stable film, no rust | stable film, no rust |

C. LUBRICITY TESTS

Blanks were coated with each lubricant. Parts were stamped in two operations. The temperature of the part was measured using an infrared thermometer. The hottest spot on the part was found and this area was used for the comparison of the parts and the lubricants. It is assumed that the lubricant that provides lower part temperatures is reducing friction and providing better part quality and longer tool life. Results on the samples as formulated under "CLEANING TESTS" were as follows:

| | First Operation | | Second Operation | |
|---|---|---|---|---|
| | Avg. Temp. | No. Parts | Avg. Temp. | No. Parts |
| Comparison of Sample A with Competitive Sample on 23" Blanks | | | | |
| Sample A | 168.0 | 9 | 223.5 | 8 |
| Competitive | 174.3 | 7 | 252.4 | 8 |
| Comparison of Sample A with Competitive Sample on 17" Blanks | | | | |
| Sample A | 135.3 | 7 | 212.8 | 5 |
| Competitive | 165.0 | 5 | 227.5 | 4 |
| Comparison of Sample B with Competitive Sample on 23" Blanks | | | | |
| Sample B | 152.0 | 7 | 191.5 | 8 |
| Competitive | 168.0 | 5 | 205.2 | 5 |

A hot melt method for coating a metal substrate with a metalworking lubricant of the above formulations is also disclosed, comprising the steps of:

melting a solid lubricant comprised of polyethylene glycol and an amine, applying the melted lubricant to the metal substrate, and allowing the melted lubricant to solidify on the metal substrate.

Optionally, the method may further comprise a cleaning step before the melting step to remove chemical contaminants. Substrates for coating need to be free of contaminants including mill oil that may be applied to the substrate by the supplier. This process allows for great flexibility in processing the incoming material. It can be put in line with a blanking line and a washer. Blanks can be coated and stored for later use. The coater could also be the first step in the press line.

The method may further comprise applying the melted lubricant to the metal substrate by roll coating.

The solid lubricant is readily meltable at an elevated temperature, above room temperature, for ease of application to the substrate with the lubricant in a molten state. Typically, a melting temperature for the solid lubricant is in the range of 115–180 degrees F.

The coating is preferably applied by a roll coater that has the following adjustments: (a) heating mechanism that can readily change the temperature of the molten lubricant. Cold conditions may require higher temperatures. Higher temperatures decrease the viscosity of the lubricant which can be related to the coating weight of lubricant applied to the substrate; (b) adjustable nip roll to facilitate the adjustment of coating weight as necessary; (c) adjustable gap between the coating rollers to facilitate different substrate thicknesses. The gap between the rollers can be used to alter the coating weight as well; (d) ability to change application rolls. Rolls can be coated with different materials of different hardness. Harder rolls are able to apply less lubricant. Rolls can be configured to coat only part of the substrate or be grauviered for other special applications; (e) ability to change the speed of the rollers. Higher speeds generally mean higher coating weights, therefore controlling the speed is necessary to coat the product as desired; (f) a heating vessel for the lubricant that can hold and mix the lubricant for uniformity and applicators that can supply the molten lubricant to the application rolls.

As shown in FIG. 1, the roll coating mechanism preferably comprises two rubber coating rolls 8 (which may be heated), one for coating each side of workpiece S. Doctor rolls 9, in contact with coating rolls 8, can be horizontally adjusted so as to regulate the thickness of the hot melt lubricant M on the coating rolls, which themselves may be vertically adjusted so as to regulate the amount of said lubricant transferred to workpiece S.

This process does not require the use of post-coating techniques to make the coating uniform like ovens to reflow the lubricant or quenching stations to cool it. This provides further energy savings and floor space savings.

Other application methods and equipment can be used such as: spray systems, drip systems, dip systems, and hand application of lubricant. The lubricant can even be applied in the solid form by rubbing.

The method preferably produces a solid lubricant coating which is essentially translucent. This provides the benefit of seeing whether the substrate is coated with the lubricant but does not mask defects on the surface of the substrate.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hot melt method for coating a metal substrate with a dry, solid metalworking lubricant comprising the steps of:

melting a dry, solid non-fatty acid, non-oil lubricant comprised of 35% to 75% by weight polyethylene glycol and an amine of 1% to 25% by weight and 0% to 30% by weight water, wherein the polyethylene glycol has a molecular weight in the range 8,000 to 20,000, applying the melted lubricant to the metal substrate, and allowing the melted lubricant to solidify on the metal substrate.

2. The hot melt method of claim 1, wherein the amine is an aliphatic amine.

3. The hot melt method of claim 1, further comprising a rust inhibitor.

4. The hot melt method of claim 1, the lubricant further comprising a phosphate ester extreme-pressure additive and lubricant.

5. The hot melt method of claim 1, the lubricant further comprising a surfactant.

6. The hot melt method of claim 1, the lubricant further comprising borax.

7. The hot melt method of claim 1, the lubricant further comprising a biocide material.

8. The hot melt method of claim 1, wherein the amine is selected from a group consisting of triethanolamine, diethanolamine, monoethanolamine, triisopropanolamine, diisopropanolamine, and monoisopropanolamine.

9. The method of claim 1, further comprising a cleaning step before the melting step.

10. The method of claim 1, wherein the melted lubricant is applied by roll coating.

11. The method of claim 1, wherein the lubricant solidifies on the metal substrate to produce a thin, transparent film.

* * * * *